US009351380B2

(12) United States Patent
Kang et al.

(10) Patent No.: US 9,351,380 B2
(45) Date of Patent: May 24, 2016

(54) LIGHT CONTROLLER

(75) Inventors: Shih-Chung Kang, Taipei (TW); I Ling Chen, Taipei (TW); Yi Wen Chen, Taipei (TW)

(73) Assignee: Center of Innovation and Synergy for Intelligent Home and Living Technology National Taiwan University, Taipei (TW)

( * ) Notice: Subject to any disclaimer, the term of this patent is extended or adjusted under 35 U.S.C. 154(b) by 296 days.

(21) Appl. No.: 13/483,304

(22) Filed: May 30, 2012

(65) Prior Publication Data

US 2012/0306405 A1 Dec. 6, 2012

(30) Foreign Application Priority Data

May 31, 2011 (TW) ..... 100119119

(51) Int. Cl.
*H05B 37/02* (2006.01)

(52) U.S. Cl.
CPC ..... *H05B 37/0272* (2013.01)

(58) Field of Classification Search
CPC ..... H05B 37/02
USPC ..... 315/149, 291, 292, 294, 297, 307, 308, 315/312
See application file for complete search history.

(56) References Cited

U.S. PATENT DOCUMENTS

| | | | | |
|---|---|---|---|---|
| 6,621,025 | B2 | 9/2003 | Yei et al. | |
| 6,975,079 | B2 * | 12/2005 | Lys | G03B 15/05 315/169.3 |
| 8,442,792 | B1 * | 5/2013 | Elberbaum | 702/107 |
| 2005/0231134 | A1 * | 10/2005 | Sid | 315/294 |
| 2007/0189026 | A1 * | 8/2007 | Chemel et al. | 362/458 |
| 2011/0245940 | A1 * | 10/2011 | Picco | 700/90 |
| 2012/0274222 | A1 * | 11/2012 | Verfuerth et al. | 315/158 |

* cited by examiner

*Primary Examiner* — Tung X Le
(74) *Attorney, Agent, or Firm* — Allen, Dyer, Doppelt, Milbrath & Gilchrist, P.A.

(57) ABSTRACT

A light controller is provided in the present invention. The light controller for adjusting a plurality of lights in a space, including a body having a slot, a touch interface and a control module; a spatial information map replaceably contained in the slot and schematically showing an information in the space; a touch interface configured on the body corresponding to the spatial information map and receiving a touch input; and a control module electrically connected with the touch interface and the plurality of lights and setting a controlled relationship on the touch interface with respect to each of the plurality of lights in accordance with the information shown by the spatial information map.

16 Claims, 9 Drawing Sheets

LIGHT CONTROLLER

CROSS REFERENCE TO RELATED APPLICATIONS

This application claims the priority of TW Application No. 100119119, filed May 31, 2011, which is incorporated by reference as if fully set forth herein in its entirety.

FIELD OF THE INVENTION

The present invention relates to a light controller, in particular to a light controller utilizing a touch-display interface.

BACKGROUND OF THE INVENTION

Illumination is necessary in human daily life, and therefore, people encounter and use a variety of "light switches" in their daily life. Without these light switches, people can not activate the light fixtures to illuminate the surroundings and to satisfy the demands for illuminations. Currently, the most commonly-seen one of the conventional light switches is the rocker type switch (rocker switch). In almost every occasion, such as home, market, office and factory, the rocker switch is a certain selection utilized to turn on or off the light fixtures. The appearance of a conventional rocker switch is demonstrated in FIG. 1(*a*), and the patents relevant to the rocker switches are typically too numerous to enumerate, for example, U.S. Pat. No. 6,621,025.

However, such conventional rocker switches have many known defects. For example, if there are many light fixtures distributed in different areas in a specific space and a set of rocker switches for commanding the distributed light fixtures are configured on the same switch panel as shown in FIG. 1(*b*), a user can hardly know which light fixtures the respective rocker switches is corresponded to and which areas in the specific space the respective light fixtures is corresponded to from the switch panel. Furthermore, the rocker switches can not adjust the brightness for the light fixtures.

Therefore, a light control bar is accordingly proposed as shown in FIG. 2. Although such light control bar can vary the brightness for the light fixtures, the user is yet unaware of which light fixtures the respective rocker switches is corresponded to and which areas in the specific space the respective light fixtures is corresponded to from the switch panel.

Hence, the conventional switches for the light fixtures actually have many defects as the aforementioned reasons. Thus the conventional light controller requires to be innovated and improved. Accordingly, in view of the drawbacks in the prior art, a novel light controller is thus provided. The unique configuration for the novel light controller in the present invention can not only solve the problems described above but is also easy to be implemented. Thus, the invention has the utility for the industry.

SUMMARY OF THE INVENTION

The present invention mainly provides a "simple and handy" light controlling panel which enables an intuitional and convenient operation of a sophisticated artificial light layout in a specific space for any user, so as to gratify demands for spatial illuminations and energy saving in human life at the same time.

Owing to the prosperous developments for the multi-touch technology, more information and operating modes can be provided in a finite displaying interface on a multi-touch panel. The present invention thus directs a touch-based technology merging into the design for light controllers, to develop a multi-touch light controller which is capable of elastically turning on or off the lights, simply adjusting the brightness for the respective lights and precisely controlling the illumination layouts, so that a user can command the lights in accordance with the practical demands to further effectively cut down the unnecessary electricity consuming on illuminations.

In accordance with the first aspect of the present invention, a light controller is provided. The light controller for adjusting a plurality of lights in a space includes a body having a slot, a touch interface and a control module; a spatial information map replaceably contained in the slot and schematically showing an information in the space; a touch interface configured on the body corresponding to the spatial information map and receiving a touch input; and a control module electrically connected with the touch interface and the plurality of lights and setting a controlled relationship on the touch interface with respect to each of the plurality of lights in accordance with the information shown by the spatial information map.

In accordance with the second aspect of the present invention, a light controller is provided. The light controller for regulating a plurality of lights in a space includes a base; a spatial information module configured on the base and showing an information in the space; a touch interface configured on the body and corresponding to the spatial information module; and a computing module configured on the base, electrically connected with the touch interface and setting a controlled relationship of each of the plurality of lights with respect to the touch interface in accordance with the information.

In accordance with the third aspect of the present invention, a light control interface is provided. The light control interface for adjusting a plurality of lights in a space includes a touch-display interface showing an information in the space; and a computing module setting a controlled relationship for each of the plurality of lights on the touch-display interface in accordance with the information.

In accordance with the fourth aspect of the present invention, a light controlling method is provided. The light controlling method for adjusting a plurality of lights in a space includes steps of providing a spatial information map in respect of the space and a touch interface; causing the touch interface to correspond to the spatial information map; and setting a controlled relationship on the touch interface with respect to each of the plurality of lights in accordance with the spatial information map, wherein a respective one of the plurality of lights is adjusted via the touch interface in accordance with the spatial information map.

In accordance with the fifth aspect of the present invention, a light controlling method is provided. The light controlling method for regulating a plurality of lights in a space includes steps of showing a spatial information map in respect of the space on a touch-display screen; and setting a controlling relationship in respect of a respective one of the plurality of lights to the touch-display screen in accordance with the spatial information map, wherein the respective one of the plurality of lights is regulated via the touch-display screen in accordance with the spatial information map.

Other objects, advantages and efficacy of the present invention will be described in detail below taken from the preferred embodiments with reference to the accompanying drawings, in which:

BRIEF DESCRIPTION OF THE DRAWINGS

FIG. 3(*b*) is the schematic diagram illustrating a spatial layout diagram which schematically and correspondingly illustrates the spatial layout for the actual portrait in the classroom in FIG. 3(*a*) in accordance with the present invention.

FIG. 3(*c*) is the schematic diagram illustrating a spatial attribution diagram which is correspondingly generated in accordance with attributions resulting from usages for respective areas in accordance with the present invention.

FIG. 3(*d*) is the schematic diagram illustrating a spatial attribution diagram which is correspondingly generated in accordance with attributions resulting from usages for respective areas in accordance with the present invention.

DETAILED DESCRIPTION OF THE PREFERRED EMBODIMENT

The present invention will now be described more specifically to the following embodiments. However, it is to be noted that the following descriptions of preferred embodiments of this invention are presented herein for the purposes of illustration and description only; it is not intended to be exhaustive or to be limited to the precise form disclosed.

Figure 1A:
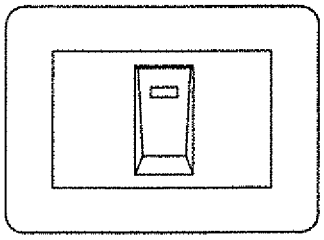
Fig. 1(a)(Prior Art)
FIGS. 1(*a*) and 1(*b*) are the schematic diagrams illustrating the conventional rocker switches.
Figure 1B:
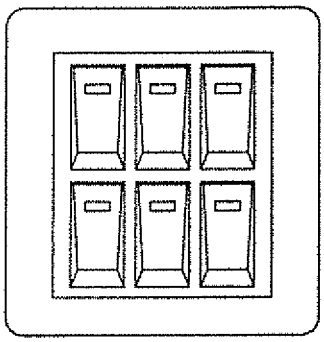
Fig. 1(b)(Prior Art)
Figure 2:
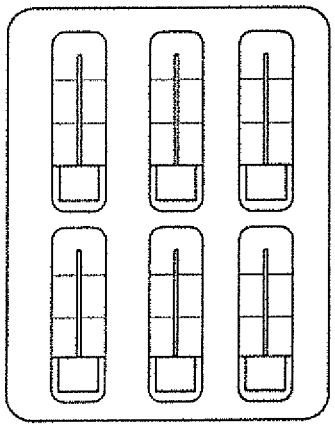
Fig. 2(Prior Art)
FIG. 2 is the schematic diagram illustrating the conventional light control bar.
Figure 3A:
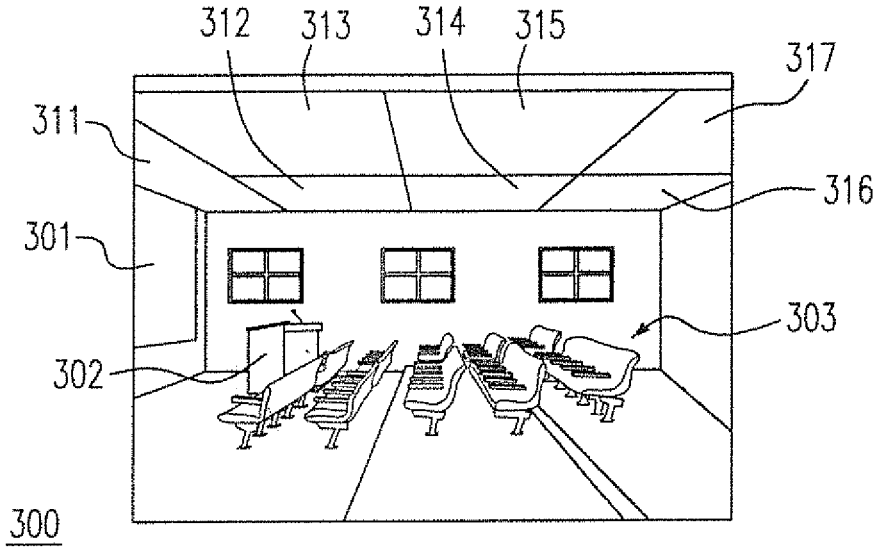
FIG. 3(*a*) is the schematic diagram illustrating an actual portrait for various equipments, objects and lights existing and arranged in a classroom in the reality space in accordance with the present invention.
Figure 3B:
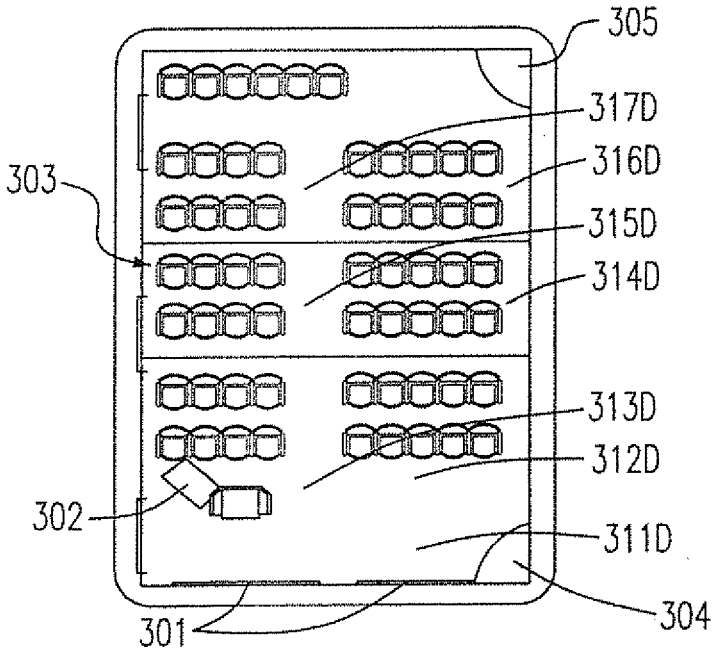
Figure 3C:
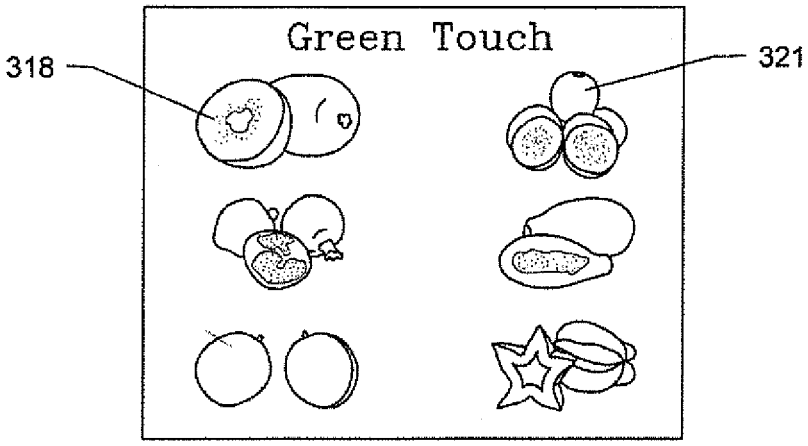
Figure 3D:
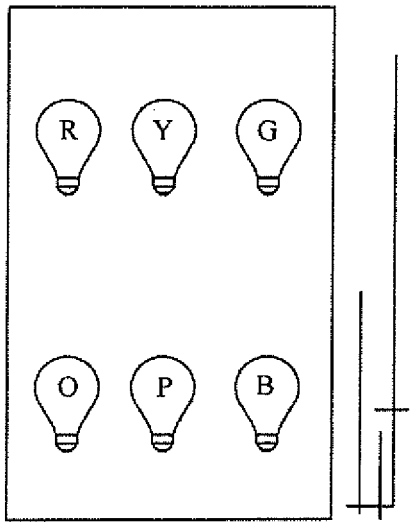

Usually, in a specific space in an indoor environment or outdoor environment, such as a space in a mall, in a classroom or in an office, there are various equipments, objects and multiple illuminating lights disposed therein. It is defined that a planar view (2D) figure or a stereo view figure 3D) schematically demonstrating an arrangement for these equipments, objects and lights allocated in such a specific space is termed as a spatial layout diagram. Moreover, these specific spaces can be grouped into various areas. Each of these areas has different usage and attribution, and these equipments, objects and lights included and allocated in the specific space have respective attributions as well. Thus, it is defined that a planar view (2D) figure or a stereo view figure 3D) schematically demonstrating respective attributions for these equipments, objects and lights in such a specific space is termed as a spatial attribution diagram.

For instance, a classroom is given as an example for illustrating a spatial layout diagram. Please refer to FIGS. 3(*a*) and 3(*b*), in which FIG. 3(*a*) is a diagram illustrating an actual portrait for various equipments, objects and lights allocated and arranged in a classroom and FIG. 3(*b*) is a spatial layout diagram schematically illustrating the layout in the classroom resulted from the actual layout in FIG. 3(*a*). The classroom 300 in FIG. 3(*a*) includes a projector curtain 301, a stage 302, chairs 303, a front door 304 and a rear door 305 (shown in FIG. 3(*b*)). There are multiple lights disposed on the ceiling in the classroom 300, which lights can be grouped into various area lights including a curtain area light 311, a front-right area light 312, a front-left area light 313, a center-right area light 314, a center-left area light 315, a rear-right area light 316 and a rear-left area light 317. The lights grouped in each of the area lights are used for illuminating different area.

FIG. 3(*b*) is derived from showing the actual layout in FIG. 3(*a*) in a schematic way and is spatial layout diagram in a planar view made in reference with the actual layout in the classroom in FIG. 3(*a*). In accordance with FIG. 3(*b*), the lights grouped into the curtain area light 311 are principally used for illuminating a curtain area 311F, the lights grouped into the front-right area light 312 are principally used for illuminating a front-right area 312F, the lights grouped into the front-left area light 313 are principally used for illuminating a front-left area 313F, the lights grouped into the center-right area light 314 are principally used for illuminating a center-right area 314F, the lights grouped into the center-left area light 315 are principally used for illuminating a center-left area 315F, the lights grouped into the rear-right area light 316 are principally used for illuminating a rear-right area 316F, and the lights grouped into the rear-left area light 317 are principally used for illuminating a rear-left area 317F. Certainly, the spatial layout diagram can be a schematic diagram in a stereo view as what is shown in FIG. 3(*e*).

For another instance, a fruit retail market dedicated to sell kiwifruits, passion fruits, apples, papayas and star fruits is given as another example for illustrating a spatial attribution diagram. Please refer to FIG. 3(*c*), which is a diagram generated in accordance with attributions resulting from usages for respective areas. For example, an area exhibiting and selling kiwifruits is presented by a kiwifruit symbol 318 and an area exhibiting and selling apples is presented by an apple symbol 321.

Furthermore, for another instance, an indoor space lighten with various colored light bubble including red, blue and yellow light bubbles is given as an example for illustrating a spatial attribution diagram. The spatial attribution diagram corresponding to the indoor space is illustrated as FIG. 3(*d*). FIG. 3(*d*) is generated in accordance with the attribution resulting from colors for the light bubbles in the indoor space. For example, the area lighten with red light bubble is presented by a bubble symbol in red color or in letter R and the area lighten with yellow light bubble is presented by a bubble symbol in yellow color or in letter Y. Moreover, a green color in letter G, an orange color, a purple color in letter P and a blue color in letter B is also present in FIG. 3(*d*).

The above-mentioned spatial layout diagram and spatial attribution diagram can be generalized as a spatial information map. Thai is to say, a spatial information map preferably refers to a spatial layout diagram or a spatial attribution diagram. While the spatial information map is ingeniously incorporated with a micro control module and a touch-based interface, a scheme that enables a user intuitionally controlling, regulating or adjusting lights in a space through the touch-based interface is formed therefrom.

Figure 4:
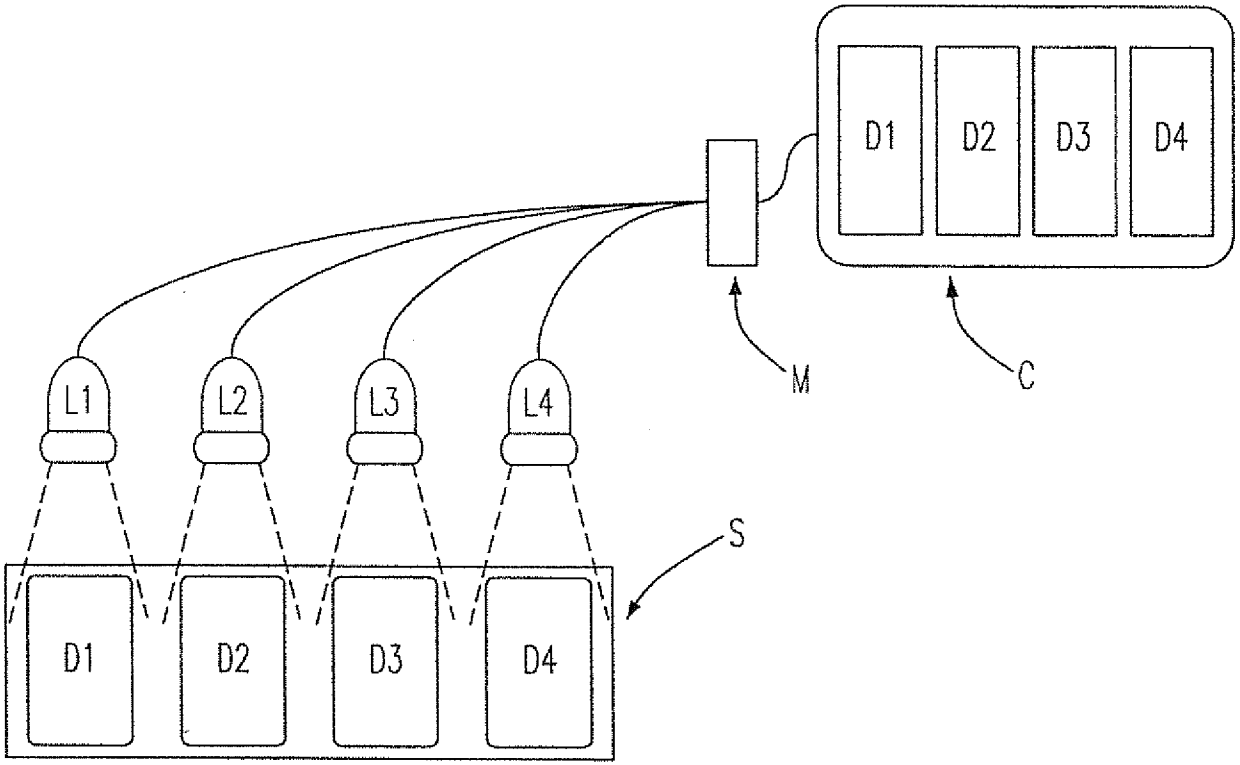
FIG. 4 is the schematic diagram illustrating the light control system in accordance with the present invention.

Please refer to FIG. 4, which is a schematic diagram illustrating the light control system according to the present invention. The light control system in FIG. 4 includes a touch interface C, a micro control module M and a reality space S. The reality space includes four lights L1, L2, L3 and L4 for illuminating four areas D1, D2, D3 and D4 respectively. The spatial layout diagram of the reality space S is the schematic diagram of the areas D1, D2, D3 and D4. The touch interface C and the micro control unit M are electrically connected with each other and the micro control module M is further electrically connected with the lights L1, L2, L3 and L4. The micro control module M includes at least a micro control unit (MCU). The micro control module M controls/adjusts/regulates the lights L1, L2, L3 and L4 in accordance with the orders, including the orders regarding controlling the lights L1, L2, L3 and L4 to switch on and off and adjust the illumination thereof, sent from the touch interface C.

It is noticed that since the spatial information map of the reality space S, especially the spatial layout diagram, is correspondingly situated on the touch interface C, the reality space S is schematically shown on the touch interface C. Furthermore, the controlled relationship on the touch interface C with respect to each of the plurality of lights L1, L2, L3 and L4 in accordance with the information shown by the spatial information map is preset in the micro control module M. For example, it is preset the controlled relationship that any touch input falling within the area D1 on the touch interface C in the micro control module M is used for correspondingly adjusting and controlling the light L1 existing in the area D1 in the reality space S, and then the micro control module M will adjust and control the light L1 in accordance with the controlled relationship preset as the event that the touch input correspondingly falling within the area D1 on the touch interface C is triggered. The controlling actions preferably provided by the controlled relationship include turning on or off the light L1 or adjusting the illumination of the light L1 etc. Accordingly, a user can control the lights L1, L2, L3 and L4 existing in the reality space S by intuitionally and conveniently operating the touch inputs on the corresponding areas D1, D2, D3 and D4 on the touch interface C.

It is noticed that the micro control module M in the light controller is capable of defining more possibly controlling actions to be included in the controlled relationship, so that the light controller can posses more abundant controlling actions as the controlling contents. For example, automatically adjusting the illumination in the indoor space in accordance with the environmental illumination in the outdoor space, adjusting the lights in accordance with the predetermined scenarios such as the romantic scenario, the relaxing scenario, the working scenario, the dinning scenario and wedding scenario etc. While a user selects a different scenario, the micro control module M will activate it and set it to an appropriate state the appropriate light in accordance with the predetermined scenario.

Figure 5A:
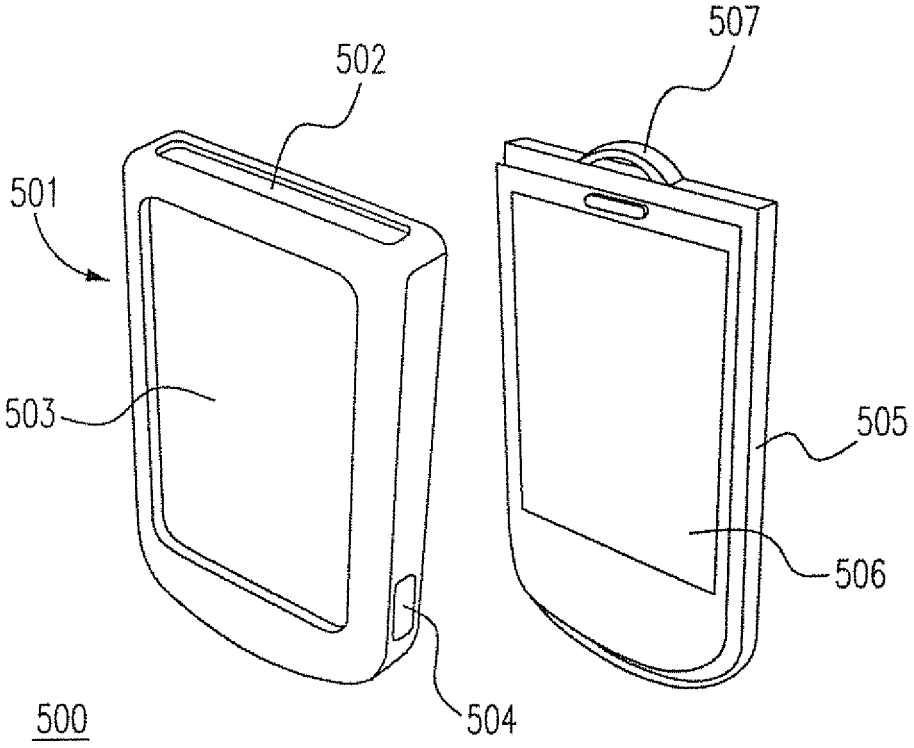
FIGS. 5(*a*), 5(*b*) and 5(*c*) are the schematic diagram illustrating a first embodiment for the light controller in accordance with the present invention.
Figure 5B:
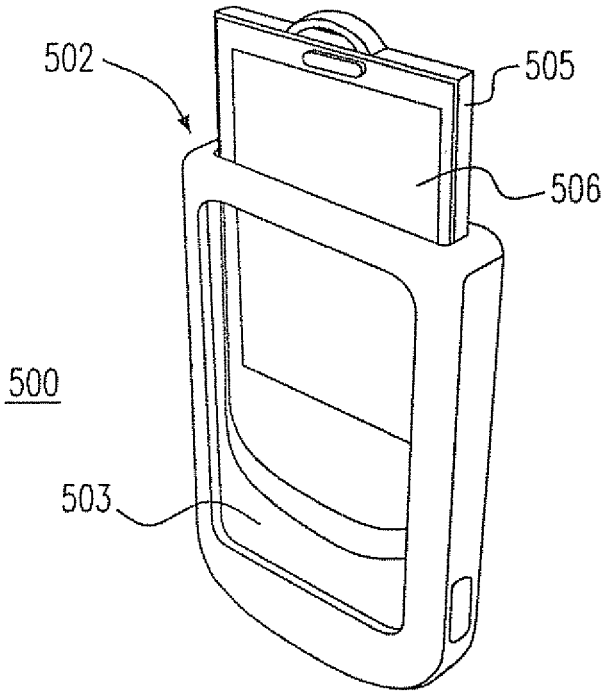
Figure 5C:
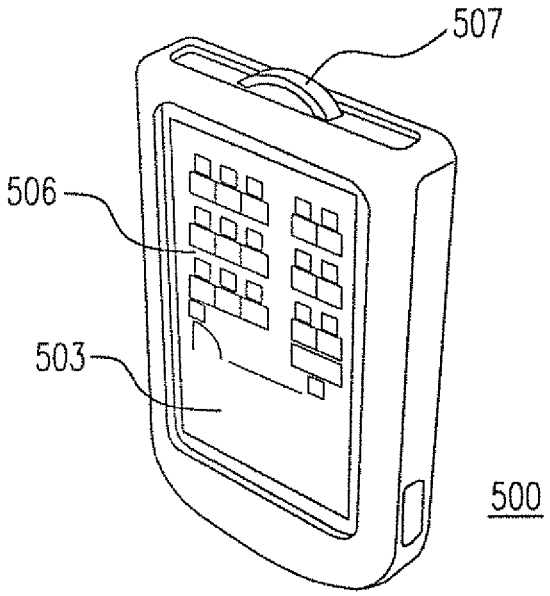

Please refer to FIGS. 5(*a*), 5(*b*) and 5(*c*) simultaneously, which are the schematic diagrams illustrating a first embodiment for the light controller in accordance with the present invention. The micro control module 504 is built in and embedded in the body 501 of the light controller 500. The micro control module 504 includes a micro control unit (MCU) core, The slot 502 is opened in the body 501 for providing a plate 505 being put thereinto and contained therein. The spatial information map 506 is attached or printed on the plate 505. A transparent touch interface 503 is disposed at the position situated on the body 501 and corresponded to the slot 502. The transparent touch interface 503 is electrically connected with the micro control module 504. The micro control module 504 is further electrically connected with the plurality of lights (not shown in Figures) which is controlled by the micro control module 504. After the plate 505 is inserted into the slot 502, the spatial information map 506 is enabled to be corresponded with the touch interface 503, so that the spatial information map 506 is displayed through the transparent touch interface 503 as shown in FIGS. 5(*b*) and 5(*c*). Since the controlled relationship on the touch interface 503 with respect to each of the plurality of lights in the reality space in accordance with the spatial information map 506 is already preset in the micro control module 504, a user can control and adjust the corresponding lights existing in the reality space by intuitionally and conveniently operating the touch inputs on the touch interface 503 in accordance with the spatial information map 506 shown on the touch interface 503.

The body 501 preferably is capable of being made of such as the plastics, the alloy or the high molecular weight polymers. The touch interface 503 is preferably a multi-touch panel, which a user can utilize multi-touch gestures to form orders so as to command the lights existing in the reality space. In addition, the touch interface 503 is preferably a resistive touch panel, a capacitive touch panel, an ultrasonic touch panel, an infrared-ray touch panel, an optical touch panel, an electromagnetic touch panel, a multi-touch-display panel or an in-cell touch panel. A protrusion part 507 is preferably formed at the upper edge of the plate 505, by which protrusion part 507 the user can well hold and grasp the plate 505, so that the user can conveniently put the plate 505 into the slot 502 or take the plate 505 out of the slot 502.

The micro control module 504 includes a micro control unit (MCU). The MCU is preferably a MCU with a firmware implemented therein, such that the controlled relationship on the touch interface 503 with respect to each of the plurality of lights in the reality space can be preset into the micro control module 504. Alternatively, the MCU can also be a programmable MCU, such that the user can freely replace the spatial information map 506 and reset the controlled relationship on the touch interface 503 with respect to each of the plurality of lights in the reality space in accordance with the newly replaced spatial information map 506. In addition, any technology relevant to the illumination adjustment for the lighting instruments, for example a LED, can be also incorporated into the micro control module 504.

Figure 6A:
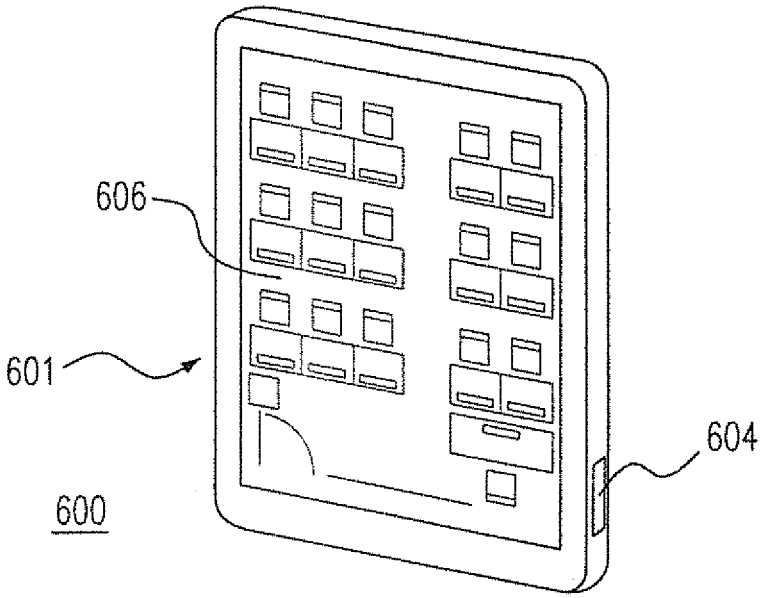
FIGS. 6(*a*) and 6(*b*) are the schematic diagram illustrating a second embodiment for the light controller in accordance with the present invention.
Figure 6B:
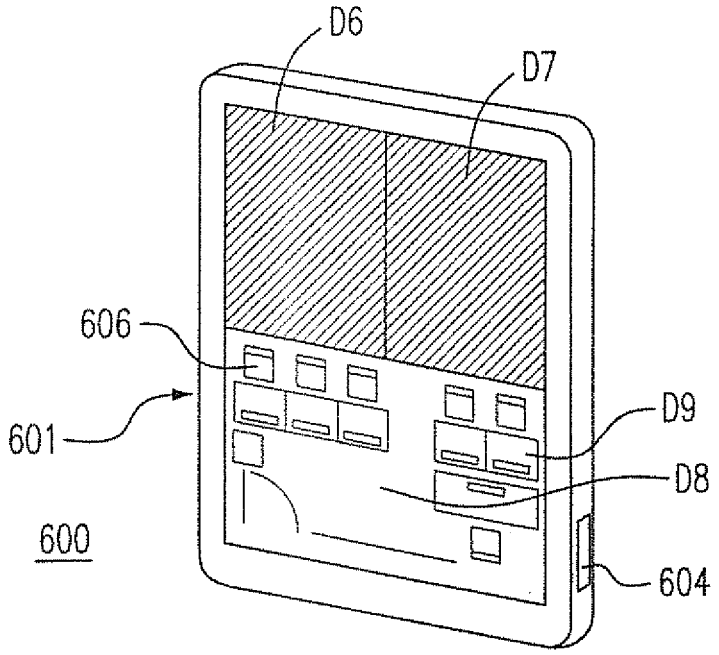

Please refer to FIGS. 6(*a*) and 6(*b*) simultaneously, which are the schematic diagrams illustrating a second embodiment for the light controller in accordance with the present invention. The light control interface 600 mainly consists of the touch-display device 601 and the micro processing module 604. The micro processing module 604 is embedded and built in the touch-display device 601 and includes a micro processing unit (MPU). The touch-display device 601 displays the spatial information map 606. The touch-display device 601 and the micro processing module 604 are electrically connected with each other and the micro processing module 604 is further electrically connected with the plurality of the lights (not shown in the Figures). Since the controlled relationship on the touch-display device 601 with respect to each of the plurality of lights in the reality space to which the spatial information map 606 corresponds is preset in the micro processing module 604, a user can simply command the corresponding lights existing in the reality space by intuitionally and conveniently operating the touch inputs on the touch-display device 601 just in accordance with the spatial information map 606 shown on the touch-display device 601.

In addition, the touch-display device 601 is preferably a resistive touch-display panel, a capacitive touch-display panel, an ultrasonic touch-display panel, an infrared ray touch-display panel, an optical touch-display panel, an electromagnetic touch-display panel, a multi-touch-display panel or an in-cell touch-display panel.

In the first embodiment, the spatial information map therein is demonstrated through the picture card drawn or printed on the plate; however, the spatial information map therein is demonstrated through the touch-display device. Therefore, the pattern for the spatial information map in the second embodiment can have much more variations to response the orders given by a user in real time. The variations include that touch-display device can synchronously demonstrate the order formed by the corresponding touch inputs on the touch-display device made by the user. For example, taking FIG. 6(*b*) as an example, the spatial information map 606 in FIG. 6(*b*) includes four areas D6, D7, D8 and D9. While a user gives an order through forming single touch input or multi-touch inputs on the light control interface 600 shown on the touch-display device 601 to request turning off the lights existing in areas D6 and D7, the touch-display device 601 can immediately transit it into a dark mode or render it becoming relatively darker the demonstrations corresponded to the areas D6 and D7 on the spatial information map 606, for interactively and specifically demonstrating the orders given by the user which is capable of facilitating the friendliness for the user interface.

It is noticed that the light controller provided in the present invention can further incorporate with the conventional mechanical rocker switch and the conventional light controller, so as to form a combined light controller capable of proceeding diverse controls for the lights and particularly suitable and applicable for various occasions. In the mean time, owing to the micro processing module built in the light controller, the function of the light controller in the present invention can be further diversely enhanced. For example, the present light controller can be combined with an intelligent indoor environmental adjustment system or a security system. Even the touch-display device can be further set to provide such as current time, power consuming display and indoor brightness information etc. Furthermore, the touch-display device with the built-in micro processing module can be linked with the internet so as to further provide such as breaking news, reading or sending E-mail messages or short messages. Hence, the present light controller accordingly becomes a smart and an integrated light controller.

Figure 7:
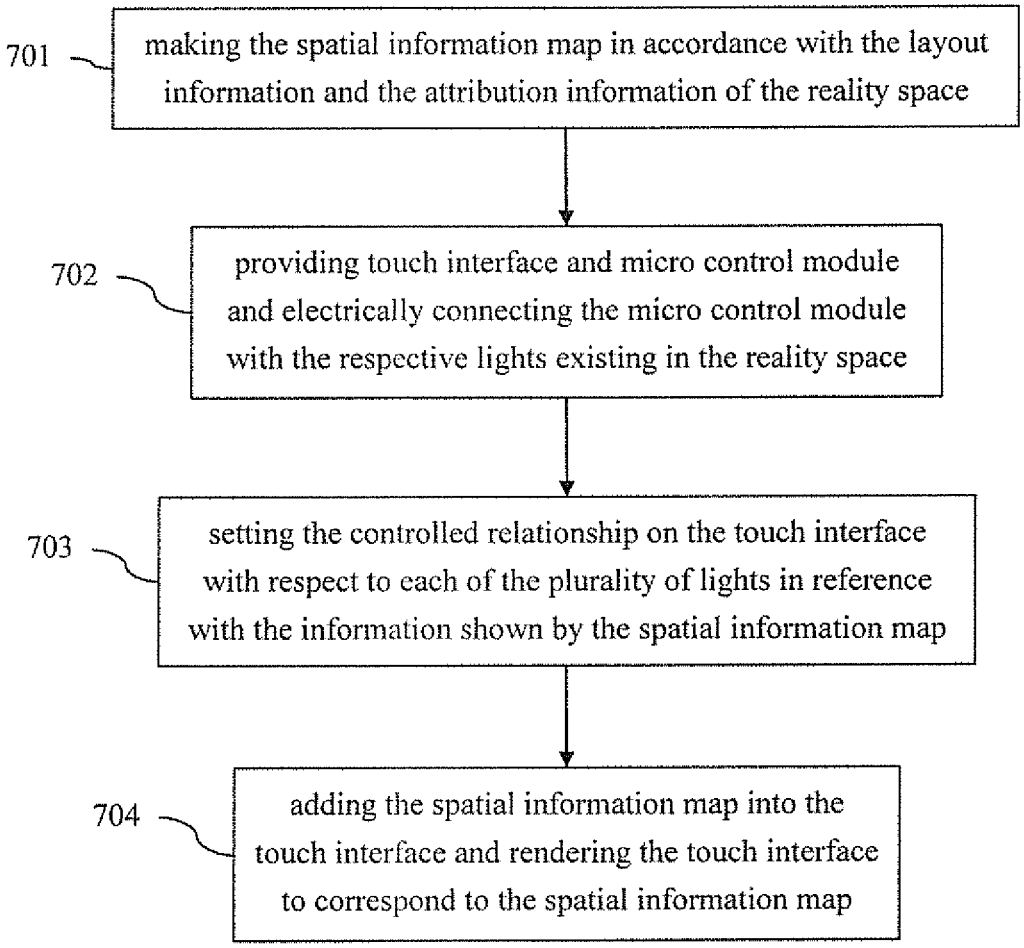
FIG. 7 is a flowchart of a light controlling method in accordance with the present invention.

To sum up, the present invention provides a light controlling method for commanding a plurality of lights in a reality space. Please keep referring to FIG. 7, which is a flow chart illustrating the first embodiment of the light controlling method in accordance with the present invention. The light controlling method in FIG. 7 includes steps as follows. The step 701: making the spatial information map in accordance with the layout information and the attribution information of the reality space. The step 702: providing touch interface and micro control module and electrically connecting the micro control module with the respective lights existing in the reality space. The step 703: setting the controlled relationship on the touch interface with respect to each of the plurality of lights in reference with the information shown by the spatial information map. The step 704: adding the spatial information map into the touch interface and rendering the touch interface to correspond to the spatial information map, so that a user can command the plurality of lights existing in the reality space by the touch interface in accordance with the spatial information map.

Figure 8:
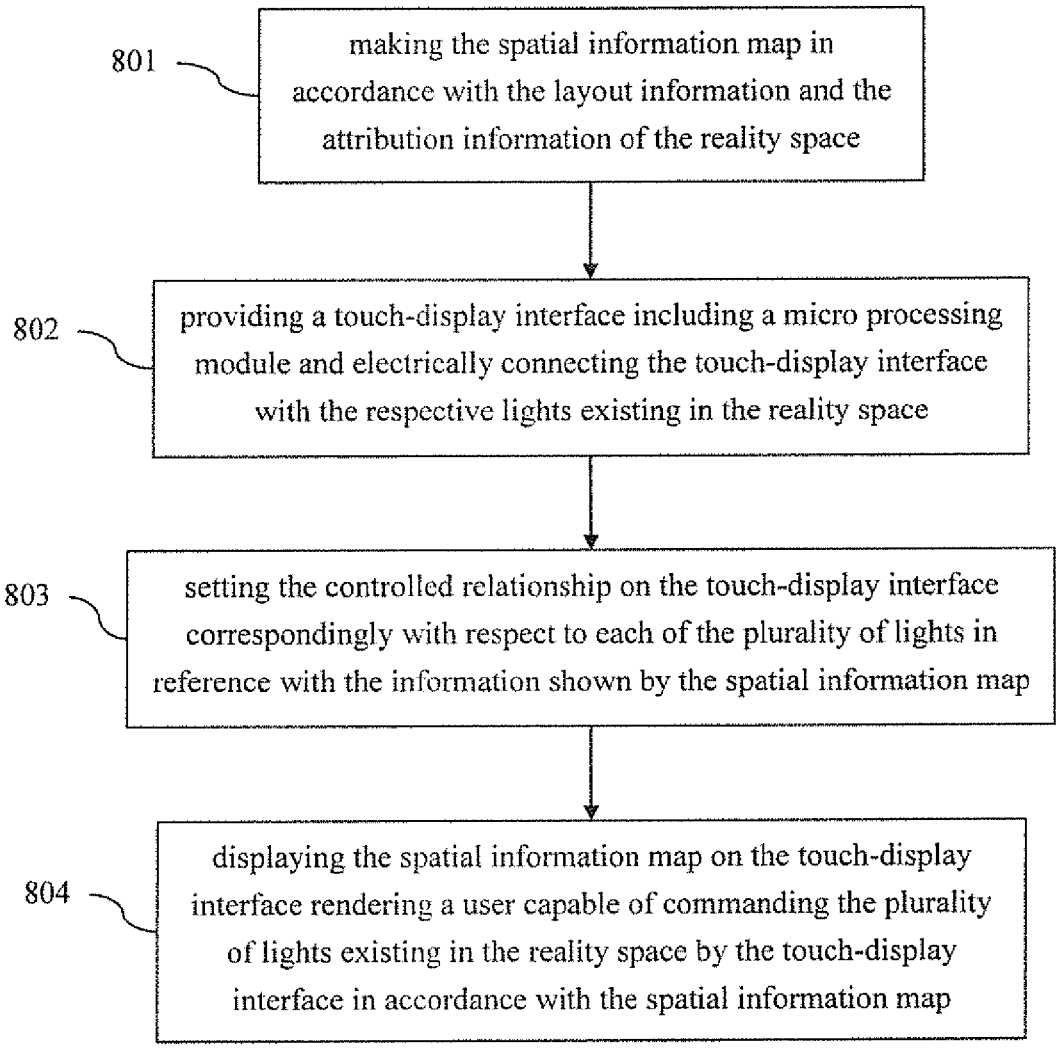
FIG. 8 is a flowchart of another embodiment of the light controlling method illustrated in FIG. 7.

Please keep referring to FIG. 8, which is a flow chart illustrating the second embodiment of the light controlling method in accordance with the present invention. The light controlling method in FIG. 8 includes steps as follows. The step 801: making the spatial information map in accordance with the layout information and the attribution information of the reality space. The step 802: providing a touch-display interface including a micro processing module and electrically connecting the touch-display interface with the respective lights existing in the reality space. The step 803: setting the controlled relationship on the touch-display interface correspondingly with respect to each of the plurality of lights in reference with the information shown by the spatial information map. The step 804: displaying the spatial information map on the touch-display interface rendering a user capable of commanding the plurality of lights existing in the reality space by the touch-display interface in accordance with the spatial information map.

There are further Embodiments provide as follows:

Embodiment 1: A light controller for adjusting a plurality of lights in a space includes a body having a slot, a touch interface and a control module; a spatial information map replaceably contained in the slot and schematically showing an information in the space; a touch interface configured on the body corresponding to the spatial information map and receiving a touch input; and a control module electrically connected with the touch interface and the plurality of lights and setting a controlled relationship on the touch interface with respect to each of the plurality of lights in accordance with the information shown by the spatial information map.

Embodiment 2: The light controller according to Embodiment 1 further includes a rocker switch electrically connected with the plurality of lights for adjusting the plurality of lights; and a light control bar electrically connected with the plurality of lights for adjusting the plurality of lights.

Embodiment 3: The light controller according to Embodiment 1, wherein the control module is built in the body and includes a micro control unit (MCU).

Embodiment 4: The light controller according to Embodiment 1, wherein the touch interface is one selected from a group consisting of a resistive touch panel, a capacitive touch panel, an ultrasonic wave touch panel, an infrared ray touch panel, an optics touch panel, an electromagnetic touch panel, a multi-touch panel and a in-cell touch panel.

Embodiment 5: The light controller according to Embodiment 1, wherein the information is one of a spatial layout information and a spatial attribution information.

Embodiment 6: The light controller according to Embodiment 1, wherein the spatial information map is one of a spatial layout diagram and a spatial attribution map.

Embodiment 7: The light controller according to Embodiment 1, wherein the spatial information map is one of a planar view diagram and a stereo view diagram.

Embodiment 8: The light controller according to Embodiment 1, wherein the controlled relationship is one of an on-off switching relationship and a illumination adjustment relationship for the plurality of lights.

Embodiment 9: A light controller for regulating a plurality of lights in a space includes a base; a spatial information module configured on the base and showing an information in the space; a touch interface configured on the body and corresponding to the spatial information module; and a computing module configured on the base, electrically connected with the touch interface and setting a controlled relationship of each of the plurality of lights with respect to the touch interface in accordance with the information.

Embodiment 10: A light control interface for adjusting a plurality of lights in a space includes a touch-display interface showing an information in the space; and a computing module setting a controlled relationship for each of the plurality of lights on the touch-display interface in accordance with the information.

Embodiment 11: The light control interface according to Embodiment 10, wherein the touch-display module is a tablet touch screen having a touch function and a display function at the same time.

Embodiment 12: The light control interface according to Embodiment 10, wherein the touch-display module is one selected from a group consisting of a resistive touch screen, a capacitive touch screen, an ultrasonic wave touch screen, an infrared ray touch screen, an optics touch screen, an electromagnetic touch screen, a multi-touch screen and a in-cell touch screen.

Embodiment 13: The light control interface according to Embodiment 10, wherein the computing module is built in the touch-display module.

Embodiment 14: The light control interface according to Embodiment 10, wherein the computing module includes a micro processing unit (MPU).

Embodiment 15: A light controlling method for adjusting a plurality of lights in a space includes steps of providing a spatial information map in respect of the space and a touch interface; causing the touch interface to correspond to the spatial information map; and setting a controlled relationship on the touch interface with respect to each of the plurality of lights in accordance with the spatial information map, wherein a respective one of the plurality of lights is adjusted via the touch interface in accordance with the spatial information map.

Embodiment 16: A light controlling method for regulating a plurality of lights in a space includes steps of showing a spatial information map in respect of the space on a touch-display screen; and setting a controlling relationship in respect of a respective one of the plurality of lights to the touch-display screen in accordance with the spatial information map, wherein the respective one of the plurality of lights is regulated via the touch-display screen in accordance with the spatial information map.

Based on the above descriptions, while the invention has been described in terms of what are presently considered to be the most practical and preferred embodiments, it is to be understood that the invention should not be limited to the disclosed embodiment. On the contrary, it is intended to cap numerous modifications and variations included within the spirit and scope of the appended claims which are to be accorded with the broadest interpretation so as to encompass all such modifications and variations. Therefore, the above description and illustration should not be taken as limiting the scope of the present invention which is defined by the appended claims.

What is claimed is:

1. A light controller for adjusting a plurality of lights in a space, comprising:

a body having a slot, a touch interface and a control module;

a spatial information map replaceably contained in the slot and schematically showing an information in the space; a touch interface configured on the body corresponding to the spatial information map and receiving a touch input; and a control module electrically connected with the touch interface and the plurality of lights and setting a controlled relationship on the touch interface with respect to each of the plurality of lights in accordance with the information shown by the spatial information map.

2. The light controller according to claim 1 further comprising:

a rocker switch electrically connected with the plurality of lights for adjusting the plurality of lights; and a light control bar electrically connected with the plurality of lights for adjusting the plurality of lights.

3. The light controller according to claim 1, wherein the control module is built in the body and comprises a micro control unit (MCU).

4. The light controller according to claim 1, wherein the touch interface is one selected from a group consisting of a resistive touch panel, a capacitive touch panel, an ultrasonic wave touch panel, an infrared ray touch panel, an optics touch panel, an electromagnetic touch panel, a multi-touch panel and a in-cell touch panel.

5. The light controller according to claim 1, wherein the information is one of a spatial layout information and a spatial attribution information.

6. The light controller according to claim 1, wherein the spatial information map is one of a spatial layout diagram and a spatial attribution map.

7. The light controller according to claim 1, wherein the spatial information map is one of a planar view diagram and a stereo view diagram.

8. The light controller according to claim 1, wherein the controlled relationship is one of an on-off switching relationship and an illumination adjustment relationship for the plurality of lights.

9. A light controller for regulating a plurality of lights in a space, comprising:

a base;

a spatial information module configured on the base and showing an information in the space;

a touch interface configured on the body and corresponding to the spatial information module; and a computing module configured on the base, electrically connected with the touch interface and setting a controlled relationship of each of the plurality of lights with respect to the touch interface in accordance with the information.

10. A light control interface for adjusting a plurality of lights distributed in a space to allow a user to control each of the plurality of lights and set a predetermined illumination scenario in the space, comprising:

a base body having a containing space therein;

a touch-display interface, which is configured on the base body, comprises a multi-touch screen having an electronic visual screen receiving a multi-touch gesture based command provided by the user and schematically shows an arrangement regarding the plurality of lights distributed in the space; and a computing module configured in the containing space and allowing the user to set up a controlled relationship of each of the plurality of shown lights with respect to the touch screen in accordance with the shown schematic arrangement by using the touch screen, wherein the touch-display interface and the computing module are all in the base body formed as a single-machine handheld unit and the single-machine handheld unit directly connects with the plurality of lights, which is a single-tier connection and a closed and primary system.

11. The light control interface according to claim 10, wherein the predetermined illumination scenario is one selected from a group consisting of a romantic scenario, a relaxing scenario, a working scenario, a dinning scenario, a wedding scenario and a combination thereof.

12. The light control interface according to claim 10, wherein the touch-display module is one selected from a group consisting of a resistive touch screen, a capacitive touch screen, an ultrasonic wave touch screen, an infrared ray touch screen, an optics touch screen, an electromagnetic touch screen, a multi-touch screen and a in-cell touch screen.

13. The light control interface according to claim 10, wherein the computing module is built in the touch-display module.

14. The light control interface according to claim 10, wherein the computing module comprises a micro processing unit (MPU).

15. A light controlling method for adjusting a plurality of lights in a space, comprising steps of:

providing a spatial information map in respect of the space and a touch interface;

causing the touch interface to correspond to the spatial information map; and setting a controlled relationship on the touch interface with respect to each of the plurality of lights in accordance with the spatial information map, wherein a respective one of the plurality of lights is adjusted via the touch interface in accordance with the spatial information map.

16. A light controlling method for regulating a plurality of lights in a space, comprising steps of:

showing a spatial information map in respect of the space on a touch-display screen; and setting a controlling relationship in respect of a respective one of the plurality of lights to the touch-display screen in accordance with the spatial information map, wherein the respective one of the plurality of lights is regulated via the touch-display screen in accordance with the spatial information map.

* * * * *